United States Patent [19]

Janicka et al.

[11] Patent Number: 5,017,270

[45] Date of Patent: May 21, 1991

[54] METHOD OF REDUCING NOX-CONTENT IN FLUE GAS DURING HEATING OF COKING OVEN

[75] Inventors: Johannes Janicka, Oberhausen; Günter Meyer; Heinz Dürselen, both of Essen, all of Fed. Rep. of Germany

[73] Assignee: Krupp Koppers GmbH, Essen, Fed. Rep. of Germany

[21] Appl. No.: 561,941

[22] Filed: Aug. 2, 1990

Related U.S. Application Data

[63] Continuation-in-part of Ser. No. 339,235, Apr. 14, 1989, abandoned.

[30] Foreign Application Priority Data

Apr. 15, 1988 [DE] Fed. Rep. of Germany ..... 3812558

[51] Int. Cl.[5] ..... C10B 5/04; C10B 21/22

[52] U.S. Cl. ..... 201/41; 202/139; 202/142

[58] Field of Search ..... 201/41; 202/139, 151, 202/141-144

[56] References Cited

U.S. PATENT DOCUMENTS

| | | | |
|---|---|---|---|
| 3,373,087 | 3/1968 | Ackeren | 202/139 |
| 3,996,109 | 12/1976 | Pries | 202/141 |
| 4,004,983 | 1/1977 | Pries | 202/142 |
| 4,244,786 | 1/1981 | Thubeauville | 202/142 |
| 4,440,599 | 4/1984 | Struck et al. | 202/141 |
| 4,704,195 | 11/1987 | Janicka et al. | 201/41 |

*Primary Examiner*—Joye L. Woodard

*Attorney, Agent, or Firm*—Michael J. Striker

[57] ABSTRACT

$NO_x$-content in a flue gas during heating of coking oven with heating trains cooperating in pairs, high and low lying combustion stages, and flue gas return at a height of a heating train sole in a circulating stream, is reduced by adjusting a circulating stream rate defined by a volume stream of a returned flue gas divided by a flue gas volume stream without returned flue gas to between 20% and 50%, maintaining a stage ratio for a stage number greater than or equal to 2 defined as an air volume stream of a lower stage divided by a total air volume stream, at between 80/I% and 140/I% wherein I is a number of stages, arranging an upper combustion stage at a height of $(45\pm10\%)\times(I-1)$ of the heating train height.

3 Claims, 4 Drawing Sheets

METHOD OF REDUCING NOX-CONTENT IN FLUE GAS DURING HEATING OF COKING OVEN

RELATED APPLICATIONS

This application is a continuation-in-part of now abandoned application Ser. No. 339,235 filed Apr. 14, 1989 and entitled "A Method of Reducing $NO_x$-content in Flue Gas During Heating of Coking Oven, and Coking Oven for Performing the Method."

BACKGROUND OF THE INVENTION

The present invention relates to a method of reducing $NO_x$-content in flue gas during heating of coking oven. More particularly, it relates to a method of reducing $NO_x$-content in flue gas during heating of coking ovens which has heating trains operating in pairs, high and low lying combustion stages, and a flue gas return at the height of the heating train sole (circulating stream). The invention also deals with a coking oven for performing the method.

It is known that nitric oxides formed in the coking ovens are first of all so-called thermal $NO_x$ products, whose formation rates depend approximately linearly from the product of the oxygen and nitrogen concentration in the flame, and exponentially on the flame temperature.

In the known method for reducing the $NO_x$ formation, a reduction of flame temperature during flue gas return or a reduction of the oxygen and nitrogen concentration by partial combustion were proposed.

The principle of the flue gas return is implemented in coking ovens and especially in form of the Koppers circulation stream oven. In this method through one or two openings in each second frame wall at the height of the heating sole, flue gas is mixed with the air and heating gas stream and leads first of all to reduction of the maximum flame temperature and also the reduction of $O_2$- and $N_2$-concentrations. This method leads to a considerable reduction of the $NO_x$ production rate.

The $NO_x$ reduction principle of the partial combustion is used in coking ovens in the form of a stage heating.

For the purpose of further lowering the $NO_x$ emission in coking ovens, theoretical and experimental researches have been conducted. An important result of these studies is the recognition that a combination of the $NO_x$ reduction principle, flue gas return (circulating stream heating) and partial combustion (stage heating) with two stages can lead to considerable reduction of the $NO_x$ production.

Basically the combination of the stage heating and circulating stream heating in coking ovens is known. The known researches however showed that a arbitrary combination of circulating stream heating and stage heating does not lead positively to a significant $NO_x$ reduction. Only with an optimal combination of the stage heating, circulating stream heating and arrangement of two combustion stages, a maximal $NO_x$ reduction can be obtained.

The findings obtained from the above mentioned research are summarized in the German document De-OS 3,443,976 (corresponding to U.S. Pat. 4,704,195). This document deals with rich gas ovens with two combustion stages, and with compound ovens with air and gas staging and flue gas return. Specifically, DE-OS 3,443,976 discloses supplying both the air and the gas to the heating train at a plurality of stages, i.e., at the height of the heating train sole, which constitutes a low level or first combustion stage, and at a height arranged between 35% and 65% of the height of the heating train, which constitutes a high level or second combustion stage.

SUMMARY OF THE INVENTION

The object of the present invention is to provide a method of reducing $NO_x$-content in flue gas during heating of coking oven to a degree which is greater than that achieved with the prior art method.

The applicants have found out that considerable reduction of $NO_x$ emission can be achieved as by the arrangement of more than two stages for rich gas operation and poor gas operation or mixture gas operation so by two- or more stage supply of only pure air for poor gas or mixture gas operation in combination with flue gas return.

In keeping with these objects and with others which will become apparent hereinafter, one feature of the present invention resides, briefly stated, in a method of the above mentioned general type which comprises the following steps:

(a) adjusting a circulating stream rate defined by a volume stream of a returned flue gas divided by a flue gas volume stream without returned flue gas, to between 20% and 30%;

(b) maintaining a stage ratio for a stage number greater than or equal to 2, defined as an air volume stream of a lower stage divided by a total air volume stream, equal to between 80/I% and 140/I% wherein I is a number of stages;

(c) arranging an upper combustion stage at a height of $(45\pm10\%)\times(I-1)$ of the heating train height;

(d) providing a plurality of poor gas supply points only at the height of the heating train sole for supplying a poor gas only at the height of the heating train sole and providing a plurality of primary air supply points at the height of the heating train sole for admixing air to the poor gas; and (e) providing a plurality of secondary air supply points at a level of the upper combustion stage for supplying only air to the heating train at the upper stage.

In accordance with another feature of the present invention, a coking oven is provided for performing the inventive method, in which the secondary air supply points are arranged exclusively in the frame walls which limit the heating train pair.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
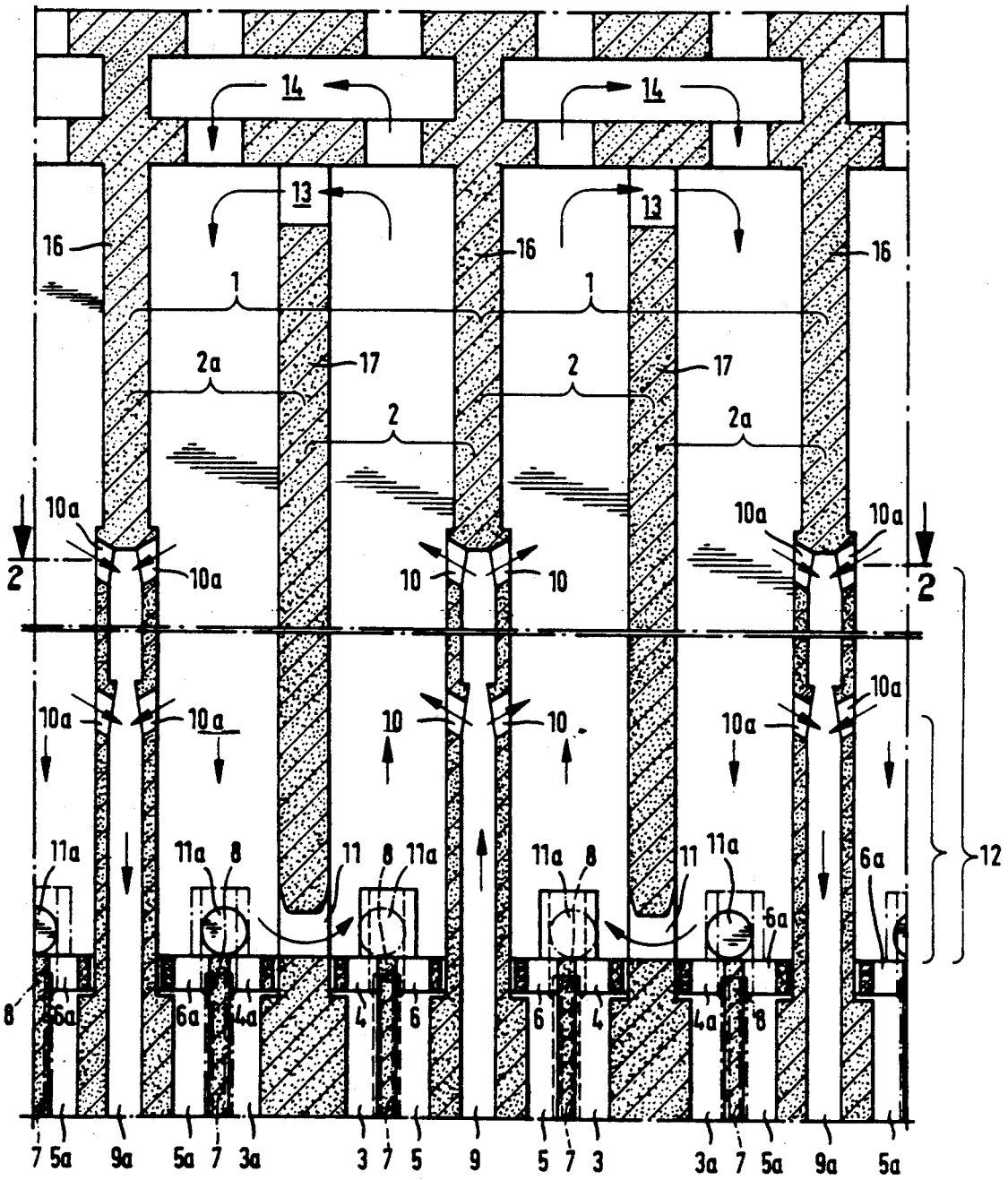
FIG. 1 is a view showing two heating trains of a combination oven in a vertical longitudinal cross-section taken along the line 1—1 in FIG. 2.

In accordance with an inventive method of reducing $NO_x$-contents in flue gas during heating of coking ovens, the circulating stream rate which is the volume stream of the returned flue gas divided by the flue gas volume stream without return gas is maintained between 20% and 50%. The stage ratio for a combustion stage number greater than or equal to 2 defined as an air volume stream of a lower combustion stage divided by a total air volume stream is equal to between 80/I% and 140/I% wherein I is a number of stages.

An upper combustion stage is arranged at between $(45\pm10\%)\times(I-1)$ of the heating train height.

In this case, for example with the number of stage 3, the stage ratio is between 26.7% and 46.7%, maximum. In other words, the lower stage supplies between 26.7% and 46.7% of the total air volume stream. The remaining air volume is approximately uniformly distributed between both upper stages.

With the stage number 3, the upper combustion stages are arranged at between 25% and 65% of the heating train height.

As mentioned above, in the coking oven the secondary air supply is performed exclusively in the frame walls which limit the heating train pair.

The embodiment of the above mentioned coking oven is shown in the drawings. The drawings show the supply of the combustion medium from not shown regenerators to the heating train pairs, the circuitry of the regenerators, the heating pair or the heating pairs for both compound oven or in other words a coking oven with selective rich gas or poor gas heating and for a rich gas oven. The direction of the medium supply (air, poor gas, rich gas, waste gas) during a heating period is identified with arrows. Since the embodiment shows a regenerative oven, the supply of the medium changes for the second period.

The heating oven has heating train pair 1, wherein an inflamed heating train is identified with reference numeral 2 and a not inflamed heating train is identified with reference numeral 2a. Primary air passages 3 and primary air passages 3a leading waste gas are provided with regulators 4 and 4a, respectively. Poor gas passages 5 and poor gas passages leading waste gas 5a are arranged as shown in FIG. 1, only in the heating train sole. The passages 5 and 5a are provided with regulators 6 and 6a, respectively. Reference numerals 7 and 8 identify a rich gas passage and a rich gas nozzle, respectively. Secondary air passages 9 and secondary air passages leading waste gas 9a are provided with regulatable outlets 10 and 10a, respectively. Regulating elements are not shown in the drawings. Only air is conducted through the secondary air passages which are located at a level of the upper combustion stage.

Reference numerals 11 and 11a identify circulating stream openings and regulating rollers for them. A height of the combustion plane up to secondary supply or in other words the height of understoichiometric combustion is identified with reference numeral 12, while a reverse point is identified as 13 and a differential passage is identified as 14. The oven has runner walls 15, frame walls 16 with secondary supply (air stage), and frame walls 17 with reverse point and circulating stream.

The flowing medium is supplied to the inflamed heat trains 2 in the following manner:

Primary air from an air generator is supplied through the passages 3 and regulatable outlets 4. The poor gas is supplied from the gas regenerator through the passages 5 and the regulatable outlets 6. The rich gas is supplied through the passages 7 and the exchangeable nozzle 8. The secondary air is supplied through the passages 9 and the regulatable outlets 10.

The return gas is supplied through the regulatable passages 13 (circulating stream openings). The partial combustion takes place above the height 12 in the inflamed heating train.

The path of the flue gas leads from the inflamed heating train 2 through the reverse point 13 (and part through the differential passage 14) into the not inflamed heating train 2a, and through the nozzles and the passages 4a, 3a, 6a, 5a, 10a, 9a to not shown waste gas regenerators.

Figure 2:
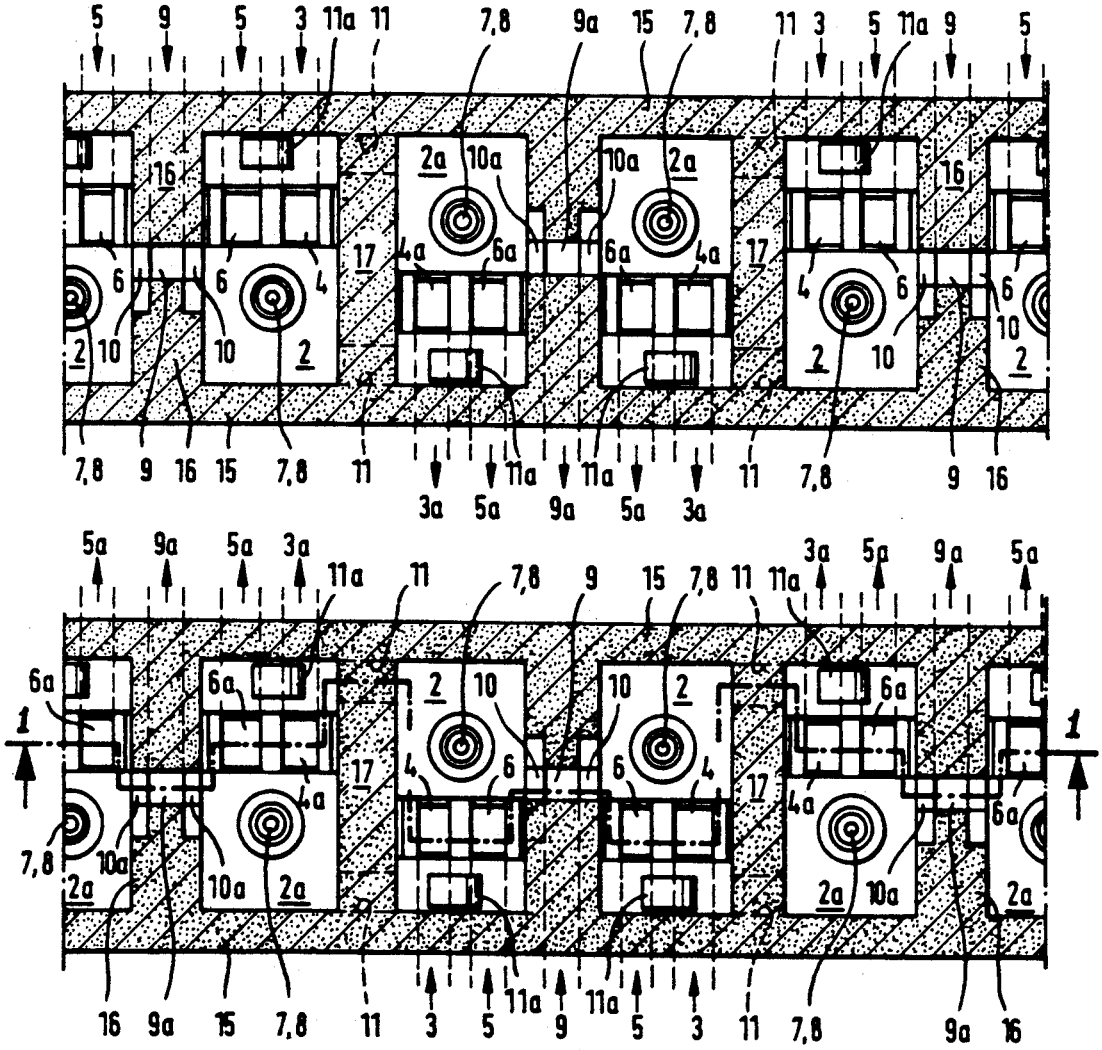
FIG. 2 is a view showing a horizontal cross-section taken along the line 2—2 of the heating train pairs of FIG. 1.
Figure 3:
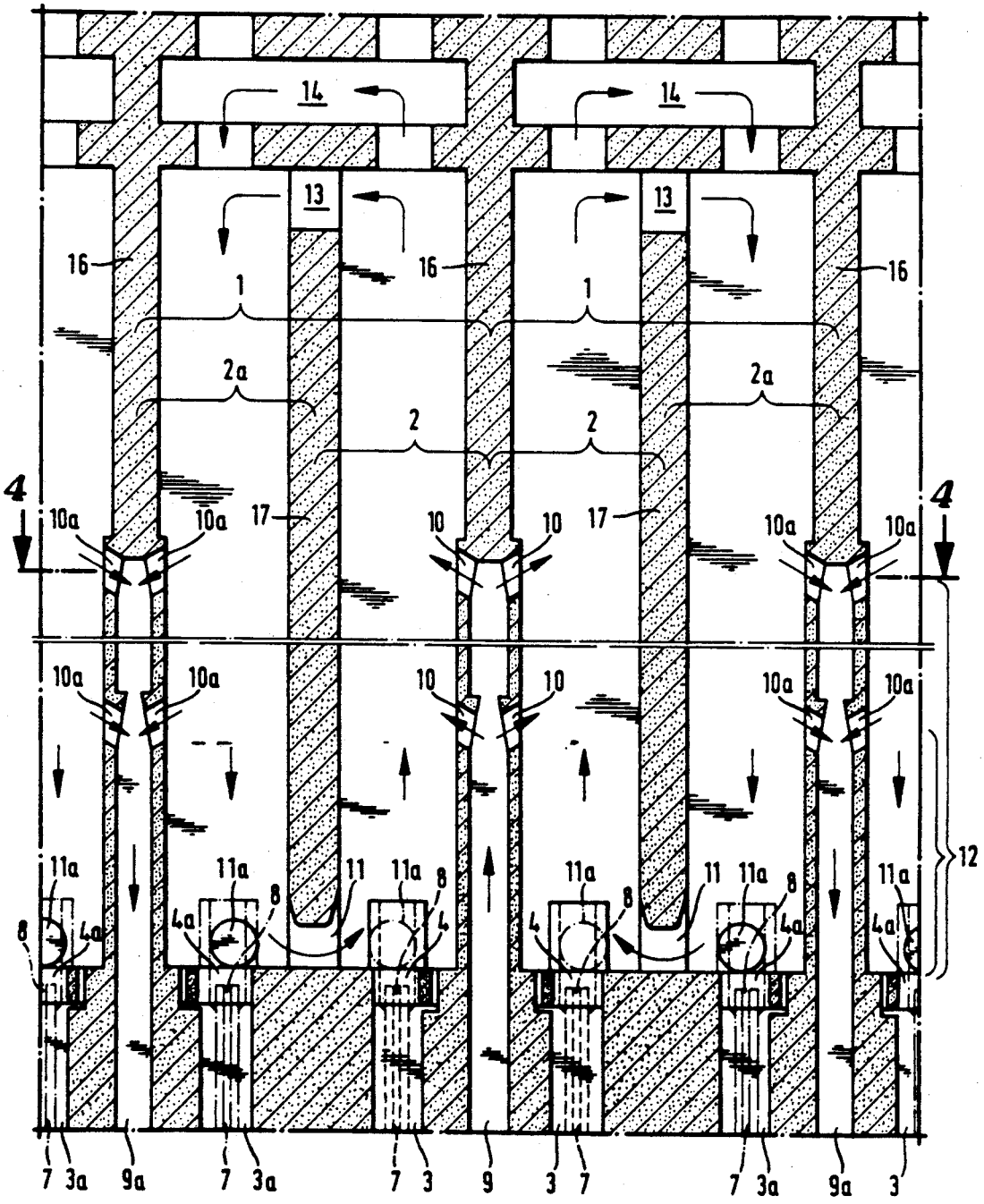
FIG. 3 is a view showing two heating train pairs of a rich gas oven in vertical longitudinal cross-section along the line 3—3 in FIG. 4.
Figure 4:
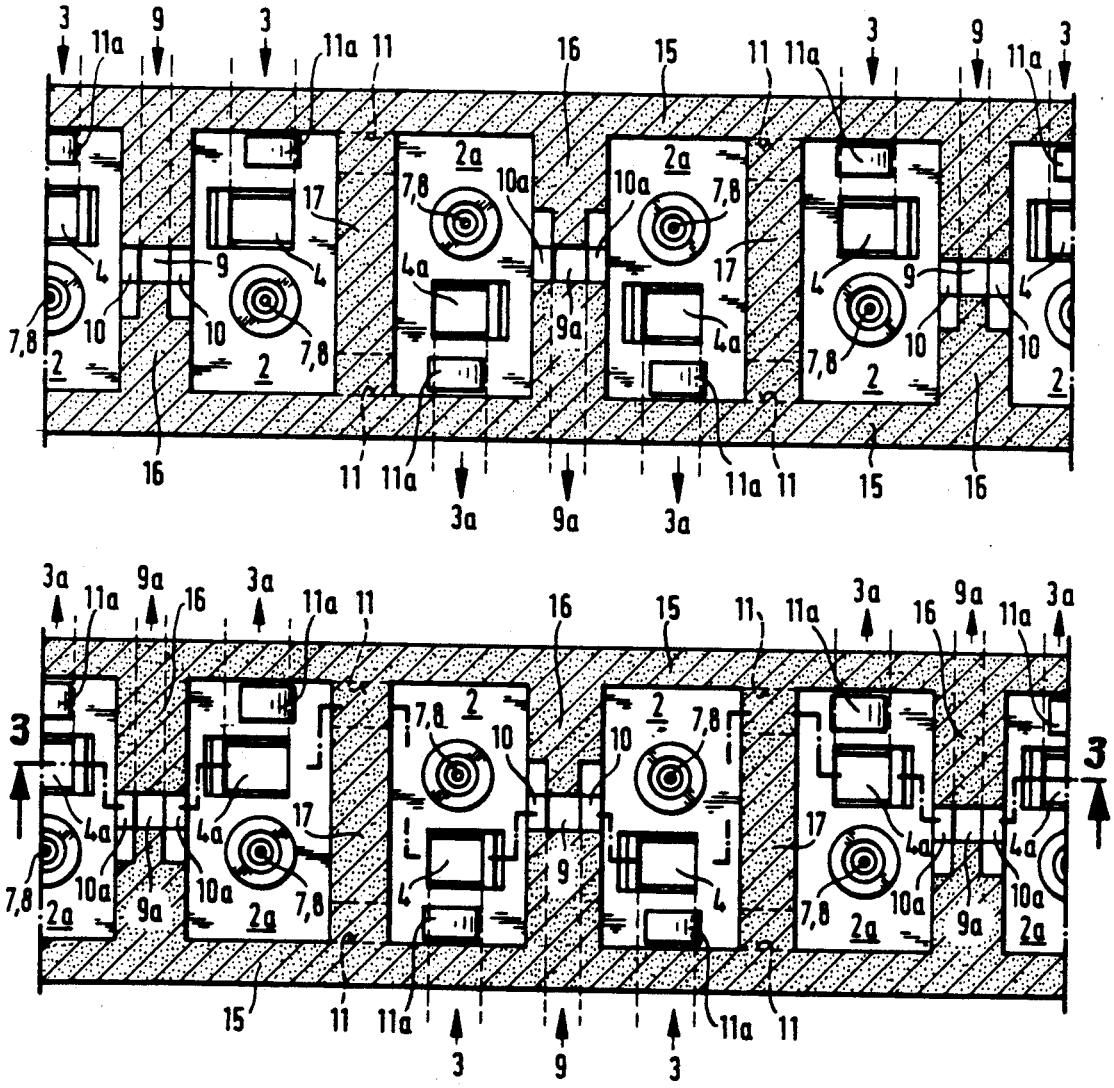
FIG. 4 is a horizontal cross-section taken along the line 4—4 of the two heating train pairs of FIG. 3.

The flow direction of the medium both for the poor gas and for the rich gas operation is identified in FIGS. 1 and 2 with arrows. During the poor gas operation no rich gas flows, while during the rich gas operation the poor gas passages lead the combustion air.

The lateral limiting of a heating train pair is performed by the runner walls 15 and also by the frame walls 16 through which the passage 9 passes. The separation of the heating train pair 1 into the heating trains 2 and 2a is performed by the frame wall 17 through which the reverse point 13 and the circulating stream opening 11 passes.

Due to the subdivision or spatial separation of the frame walls into "circulating stream containing" and "air passage containing" in combination with the free poor gas outlets, favorable flow conditions are insured for providing an extensive admixture of circulating stream in the combustion medium of the lower stage.

It will be understood that each of the elements described above, or two or more together, may also find a useful application in other types of constructions and methods differing from the types described above.

While the invention has been illustrated and described as embodied in a method of reducing $NO_x$-contents in flue gas during heating of coking ovens and coking ovens provided for performing the method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of reducing $NO_x$-content in a flue gas during heating of a coking oven having a plurality of heating trains cooperating in pairs with a flue gas return passage in each of said pairs at the height of the heating train sole defining a lower combustion stage and an upper combustion stage arranged the lower combustion stage, said method comprising the steps of:

adjusting a circulating stream rate defined by a volume stream of a returned flue gas divided by a flue gas volume stream without returned flue gas to between 20% and 50%;

maintaining a stage ratio for a combustion stage number equal at least to 2 defined as an air volume stream of the lower combustion stage divided by a total air volume stream, equal to between 80/I% and 140/I% wherein I is the number of combustion stages;

arranging the upper combustion stage at $(45\pm10\%)\times(I-1)$ of the heating train height;

providing a plurality of poor gas supply points only at the height of the heating train sole for supplying poor gas only at the height of the heating train sole and providing a plurality of primary air supply points at the height of the heating train sole for admixing air to the poor gas; and providing a plurality of secondary air supply points at the level of the upper combustion stage for supplying only air to the upper combustion stage.

2. A method as defined in claim 1, wherein said step of arranging the upper combustion stage includes arranging the upper combustion stage between minimum 15% and maximum 85% of the heating train height.

3. A method as defined in claim 1, wherein said step of providing a plurality of secondary air supply points includes arranging the plurality of the secondary air supply points exclusively in frame walls which limit each one of the heating train pairs.

* * * * *